US011626243B2

(12) United States Patent
Takezawa et al.

(10) Patent No.: US 11,626,243 B2
(45) Date of Patent: Apr. 11, 2023

(54) COIL COMPONENT

(71) Applicant: Murata Manufacturing Co., Ltd., Kyoto-fu (JP)

(72) Inventors: Kaori Takezawa, Nagaokakyo (JP); Kohei Kobayashi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 595 days.

(21) Appl. No.: 16/440,742

(22) Filed: Jun. 13, 2019

(65) Prior Publication Data

US 2020/0005993 A1 Jan. 2, 2020

(30) Foreign Application Priority Data

Jul. 2, 2018 (JP) ..... JP2018-125898

(51) Int. Cl.
*H01F 27/29* (2006.01)
*H01F 27/24* (2006.01)
*H01F 27/28* (2006.01)

(52) U.S. Cl.
CPC ..... *H01F 27/29* (2013.01); *H01F 27/24* (2013.01); *H01F 27/2823* (2013.01)

(58) Field of Classification Search
CPC ..... H01F 27/29; H01F 27/24; H01F 27/2823; H01F 27/2828; H01F 17/045; H01F 27/292; H01F 27/306; H01F 2017/048
See application file for complete search history.

(56) References Cited

U.S. PATENT DOCUMENTS 4,797,648 A * 1/1989 Kaneko ..... H01F 27/292 228/124.1
2015/0115776 A1* 4/2015 Terashita ..... H01L 41/0477 310/365
2015/0116901 A1* 4/2015 Sasaoka ..... H01G 4/30 361/301.4
2015/0279567 A1 10/2015 Nishisaka et al.
2017/0287634 A1* 10/2017 Baba ..... H01F 17/0033
2017/0365399 A1* 12/2017 Kobayashi ..... H01F 27/2828
2018/0130597 A1* 5/2018 Komaya ..... H01F 17/045
2018/0137964 A1* 5/2018 Tozawa ..... H01F 27/245
2018/0158591 A1 6/2018 Kobayashi et al.
2019/0080834 A1* 3/2019 Someya ..... H01F 17/045
2019/0115145 A1* 4/2019 Kim ..... H01F 41/041

FOREIGN PATENT DOCUMENTS

JP H11-204346 A 7/1999
JP 2000306757 A * 11/2000
JP 2015-195293 A 11/2015
JP 2018-093010 A 6/2018

* cited by examiner

*Primary Examiner* — Mang Tin Bik Lian
(74) *Attorney, Agent, or Firm* — Studebaker & Brackett PC

(57) ABSTRACT

A coil component in which a terminal electrode includes a bottom surface electrode portion that is positioned along a bottom surface of a flange part, an end surface electrode portion that is positioned along an outer end surface of the flange part, and a plating film that covers the bottom surface electrode portion and the end surface electrode portion in a continuous manner. The bottom surface electrode portion contains Ag and Si. The end surface electrode portion is composed of a metal film.

13 Claims, 5 Drawing Sheets

COIL COMPONENT

CROSS-REFERENCE TO RELATED APPLICATION

This application claims benefit of priority to Japanese Patent Application No. 2018-125898, filed Jul. 2, 2018, the entire content of which is incorporated herein by reference.

BACKGROUND

Technical Field

The present disclosure relates to a coil component, and in particular relates to a winding-type coil component equipped with at least two wires.

Background Art

FIG. 5 is FIG. 1 from Japanese Unexamined Patent Application Publication No. 11-204346. FIG. 5 illustrates the appearance of a drum-shaped core 2 that is included in a winding-type common mode choke coil, as an example of a winding-type coil component. FIG. 5 illustrates the drum-shaped core 2 in an orientation where a surface thereof that will face a mounting substrate faces upward.

The common mode choke coil includes the drum-shaped core 2, and a first wire and a second wire (not illustrated), which form inductors. The drum-shaped core 2 has a winding core part 5, and a first flange part 6 and a second flange part 7 that are respectively provided at a first end and a second end, which are opposite ends, of the winding core part 5. The first wire and the second wire are wound around the winding core part 5 in a helical manner from the end of the winding core part 5 adjacent to the first flange part 6 to the end of the winding core part 5 adjacent to the second flange part 7 so as to have substantially identical numbers of turns.

In more detail, the first flange part 6 has a bottom surface 8 that faces a mounting substrate at the time of mounting, a top surface 10 that faces in the opposite direction from the bottom surface 8, a first side surface 12 and a second side surface 14 that face in opposite lateral directions, an inner end surface 16 that faces the winding core part 5, and an outer end surface 18 that faces outwardly on the opposite side from the inner end surface 16. The first and second side surfaces 12 and 14 and the inner and outer end surfaces 16 and 18 extend in directions perpendicular to the mounting substrate.

Similarly to the first flange part 6, the second flange part 7 has a bottom surface 9 that faces a mounting substrate at the time of mounting, a top surface 11 that faces in the opposite direction from the bottom surface 9, a first side surface 13 and a second side surface 15 that face in opposite lateral directions, an inner end surface 17 that faces the winding core part 5, and an outer end surface 19 that faces outwardly on the opposite side from the inner end surface 17. The first and second side surfaces 13 and 15 and the inner and outer end surfaces 17 and 19 extend in directions perpendicular to a mounting substrate.

Two first terminal electrodes 20 and 21 are provided on the first flange part 6 and two second terminal electrodes 22 and 23 are provided on the second flange part 7. A recess 24, which separates the two first terminal electrodes 20 and 21 from each other, is provided in the bottom surface 8 of the first flange part 6, and a recess 25, which separates the two second terminal electrodes 22 and 23 from each other, is provided in the bottom surface 9 of the second flange part 7.

A first end and a second end, which are opposite ends, of the first wire are connected to one first terminal electrode 20 and one second terminal electrode 22, and a first end and a second end, which are opposite ends, of the second wire are connected to another first terminal electrode 21 and another second terminal electrode 23. For example, thermocompression bonding is used to form the connections between the wires and the terminal electrodes 20 to 23.

SUMMARY

The above-described terminal electrodes 20 to 23 are formed using a baked thick film as a base layer and performing plating on the base layer. The baked thick film is for example formed by preparing a resin conductive paste that includes Ag powder as a conductive component and Si as a glass component, coating the bottom surfaces 8 and 9 of the flange parts 6 and 7 with the resin conductive paste using a dipping technique, and then performing baking in order to sinter the glass component while volatizing the resin paste component. Therefore, the baked thick film contains Ag and Si. The plating film is for example formed by sequentially performing Ni plating and Sn plating.

Since the above-described plating film is deposited only in regions where the baked thick film is formed, the contour shape of the baked thick film is reflected in the contour shape of the plating film. Therefore, the contour shapes of the terminal electrodes 20 to 23 are controlled by the contour shape of the baked thick film.

As illustrated in FIG. 5, as well as being formed on the bottom surface 8 of the first flange part 6, the first terminal electrodes 20 and 21 are also formed so as to extend onto part of each of the plurality of surfaces 12, 14, 16, and 18 adjacent to the bottom surface 8 and the two side surfaces that define the recess 24. Similarly, as well as being formed on the bottom surface 9 of the second flange part 7, the second terminal electrodes 22 and 23 are also formed so as to extend onto part of each of the plurality of surfaces 13, 15, 17, and 19 adjacent to the bottom surface 9 and the two side surfaces that define the recess 25. The height of these adjacent surface extension portions of the terminal electrodes 20 to 23 described above is indicated by "H1" in FIG. 5.

The height H1 of the adjacent surface extension portions of the terminal electrodes 20 to 23 described above affects the adhesion strength of the common mode choke coil 1 when the common mode choke coil 1 is mounted on a mounting substrate using solder. In other words, when the height H1 of the adjacent surface extension portions is small, the bonding area between the terminal electrodes 20 to 23 and the flange parts 6 and 7 is small, and therefore the bonding strength between the terminal electrodes 20 to 23 and the flange parts 6 and 7 is low. In addition, when the height H1 of the adjacent surface extension portions is small, adequate solder fillets will not be formed when the common mode choke coil 1 is mounted on the mounting substrate, and it is unlikely that sufficient adhesion strength will be obtained between the common mode choke coil 1 mounted in this state and the mounting substrate. Therefore, it is preferable that the height H1 of the adjacent surface extension portions be higher from the viewpoint of adhesion performance.

On the other hand, as the height H1 of the adjacent surface extension portions increases, the edges of the terminal electrodes 20 to 23 come closer and closer to the winding core part 5, and consequently there is a fear that unwanted contact and electrical short circuits will occur between the wires wound around the winding core part 5 and the terminal electrodes 20 to 23. In addition, it also becomes more difficult to wind the wires around the winding core part 5 in multiple layers as the wires and terminal electrodes 20 to 23 become closer together.

Making the height H1 of the adjacent surface extension portions large while making the height H1 of only the extension portions on the inner end surfaces 16 and 17 small may be considered as a way of both making the adhesion strength high and making it unlikely that unwanted contact will occur between the wires and the terminal electrodes 20 to 23 as described above. However, as described above, since the baked thick film, which serves as the base layer of the terminal electrodes 20 to 23, is formed by coating the bottom surfaces 8 and 9 with a conductive paste using a dipping technique, the edges of the baked thick film consequently have a linear shape resulting from the surface of the conductive paste bath into which the bottom surfaces 8 and 9 are dipped, and therefore the height H1 has to be less than or equal to the depth of the recess 24 and 25 in order to prevent shorts between the terminal electrodes 20 to 23. Thus, there is hardly any freedom of design with respect to the shape of the terminal electrodes 20 to 23.

This problem is not limited to a winding-type common mode choke coil and a similar problem may also arise in other winding-type coil components that include a plurality of wires and in which a plurality of terminal electrodes are provided on flange parts thereof such as a winding-type transformer or a balun.

Consequently, the present disclosure provides a winding-type coil component that is capable of both making adhesion strength in a mounted state high and making it unlikely that unwanted contact will occur between wires and terminal electrodes.

A coil component according to an embodiment of the present disclosure includes a substantially drum-shaped core having a winding core part, and a first flange part and a second flange part, which are respectively provided at a first end and a second end, which are opposite ends, of the winding core part. The coil component further includes a first wire and a second wire that are wound around the winding core part, and a plurality of terminal electrodes that are each provided on the first flange part or the second flange part and to each of which either of a first end and a second end, which are opposite ends, of the first wire or the second wire is electrically connected.

In this coil component, the first flange part and the second flange part each have a bottom surface that faces a mounting substrate at a time of mounting, a top surface that faces in an opposite direction from the bottom surface, an inner end surface that faces the winding core part, and an outer end surface that faces outwardly on an opposite side from the inner end surface. The inner and outer end surfaces extend in a direction perpendicular to the mounting substrate.

In addition, in the coil component, the terminal electrodes each include a bottom surface electrode portion that is positioned along the bottom surface, an end surface electrode portion that is positioned along the outer end surface, and a plating film that covers the bottom surface electrode portion and the end surface electrode portion in a continuous manner. The bottom surface electrode portion contains Ag and Si and the end surface electrode portion is composed of a metal film.

According to the above-described coil component, each terminal electrode further includes the end surface electrode portion in addition to the bottom surface electrode portion, and the bottom surface electrode portion and the end surface electrode portion are covered in a continuous manner by at least the plating film. Therefore, the bonding area between each terminal electrodes and the respective flange part of the drum-shaped core is increased, and therefore the bonding strength between the terminal electrode and the flange part can be increased. Furthermore, when the coil component is mounted using solder, an adequate solder fillet is formed along the end surface electrode portion and the plating film formed thereon. Due to these two points, the adhesion strength of the coil component with respect to the mounting substrate when the coil component is in a mounted state can be increased.

Furthermore, since each terminal electrode has an end surface electrode portion independently of the bottom surface electrode portion, the adhesion strength of the coil component with respect to the mounting substrate can be increased in accordance with the height of the end surface electrode portion as described above even when the heights of adjacent surface extension portions of the bottom surface electrode portion are not large. Therefore, it is possible to both make adhesion strength in a mounted state high and make it unlikely that unwanted contact between wires on the winding core part and terminal electrodes on the flange parts will occur.

Other features, elements, characteristics and advantages of the present disclosure will become more apparent from the following detailed description of a preferred embodiment of the present disclosure with reference to the attached drawings.

DETAILED DESCRIPTION

Figure 1:
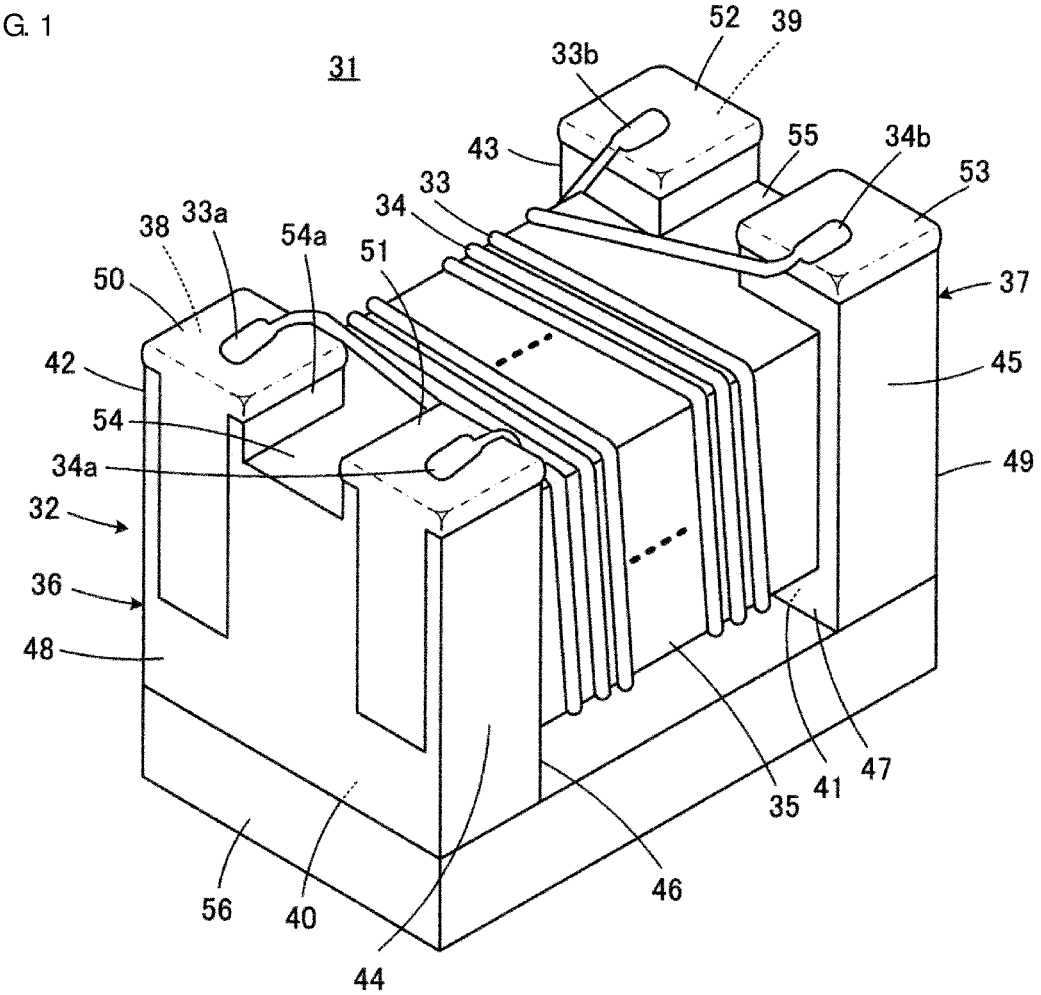
FIG. 1 is a perspective view illustrating the appearance of a coil component according to an embodiment where the surface that will face a mounting substrate is on the upper side.
Figure 2:
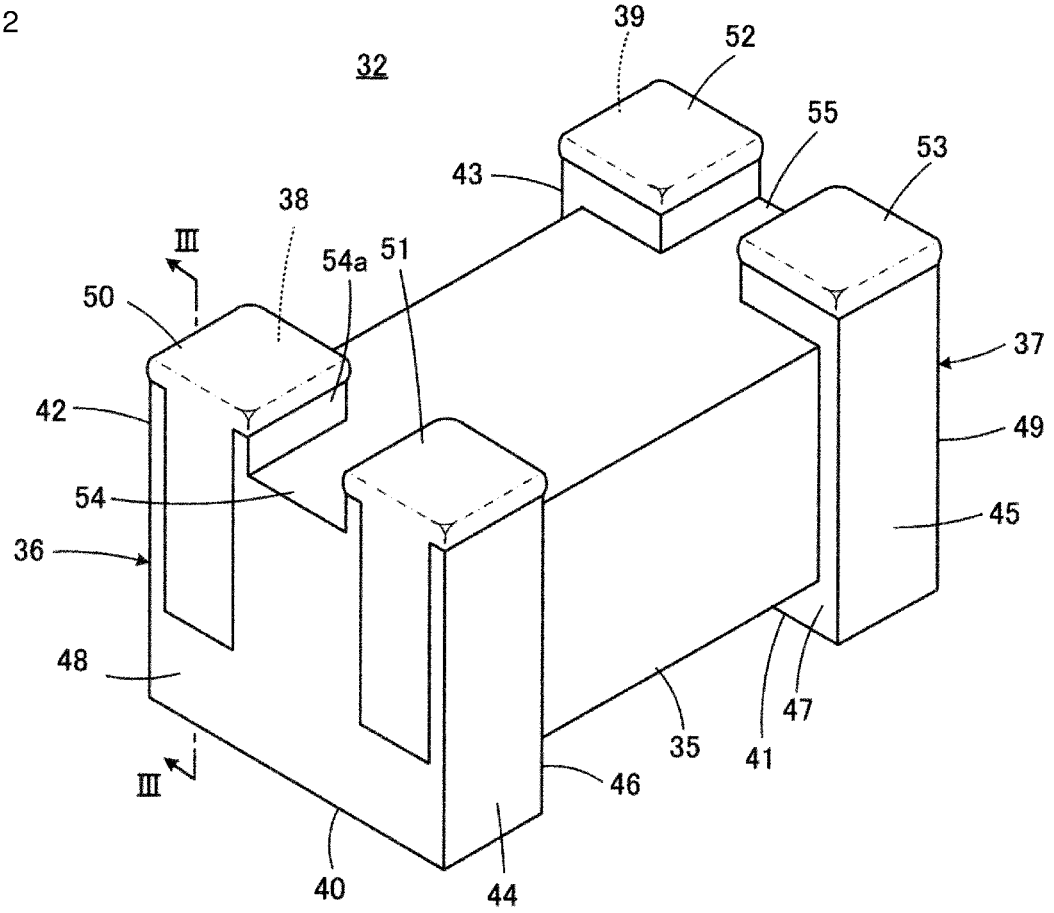
FIG. 2 is a perspective view illustrating a drum-shaped core of the coil component illustrated in FIG. 1 in a standalone state.

A coil component 31 according to an embodiment of the present disclosure will be described while referring to FIGS. 1 and 2. In FIGS. 1 and 2, the coil component 31 and a substantially drum-shaped core 32 are illustrated with the surface that will face a mounting substrate being on the upper side. The illustrated coil component 31 is included in a common mode choke coil, for example.

The drum-shaped core 32 of the coil component 31 includes a winding core part 35 that extends in an axial direction and around which a first wire 33 and a second wire 34 are arranged, and a first flange part 36 and a second flange part 37 that are respectively provided at a first end and a second end, which are opposite ends, of the winding core part 35. The drum-shaped core 32 may be formed of a non-conductive material, more specifically, a non-magnetic material such as alumina, a magnetic material such as ferrite, or a resin, and is preferably formed of a ceramic such as alumina or ferrite.

The winding core part 35 and the first flange part 36 and the second flange part 37 of the drum-shaped core 32 form a substantially quadrangular prism shape having a substantially quadrangular cross-sectional shape, for example. Furthermore, edge portions of the quadrangular-prism-shaped winding core part 35 and flange parts 36 and 37 are preferably subjected to R chamfering.

The first flange part 36 has a bottom surface 38 that will face the mounting substrate at the time of mounting, a top surface 40 that faces in the opposite direction from the bottom surface 38, an inner end surface 46 that faces the winding core part 35, an outer end surface 48 faces outwardly on the opposite side from the inner end surface 46, and a first side surface 42 and a second side surface 44 that are perpendicular to the inner end surface 46 and the outer end surface 48 and face in opposite lateral directions. The inner and outer end surfaces 46 and 48 and the first and second side surfaces 42 and 44 extend in directions perpendicular to the mounting substrate.

Similarly to the first flange part 36, the second flange part 37 has a bottom surface 39 that will face the mounting substrate at the time of mounting, a top surface 41 that faces in the opposite direction from the bottom surface 39, an inner end surface 47 that faces the winding core part 35, an outer end surface 49 faces outwardly on the opposite side from the inner end surface 47, and a first side surface 43 and a second side surface 45 that are perpendicular to the inner end surface 47 and the outer end surface 49 and face in opposite lateral directions. The inner and outer end surfaces 47 and 49 and the first and second side surfaces 43 and 45 extend in directions perpendicular to the mounting substrate.

Two first terminal electrodes 50 and 51 are provided on the bottom surface 38 of the first flange part 36. Two second terminal electrodes 52 and 53 are provided on the bottom surface 39 of the second flange part 37. A recess 54, which separates the two first terminal electrodes 50 and 51 from each other, is provided in the bottom surface 38 of the first flange part 36, and a recess 55, which separates the two second terminal electrodes 52 and 53 from each other, is provided in the bottom surface 39 of the second flange part 37.

The structures of the terminal electrodes 50 to 53 will be described in detail later while referring to FIGS. 3 and 4.

The wires 33 and 34 are for example composed of copper wire coated with an insulator composed of a resin such as imide-modified polyurethane or polyamide imide. The wires 33 and 34 are wound around the winding core part 35 in a helical manner. A first end 33*a* of the first wire 33 is connected to one first terminal electrode 50 and a second end 33*b*, which is at the opposite end from the first end 33*a*, of the first wire 33 is connected to one second terminal electrode 52. A first end 34*a* of the second wire 34 is connected to another first terminal electrode 51 and a second end 34*b*, which is at the opposite end from the first end 34*a*, of the second wire 34 is connected to another second terminal electrode 53. For example, thermocompression bonding is used to form the connections between the terminal electrodes 50 to 53 and the wires 33 and 34.

The coil component 31 may further include a substantially plate-shaped core 56 that spans between the top surface 40 of the first flange part 36 and the top surface 41 of the second flange part 37. Similarly to the drum-shaped core 32, the plate-shaped core 56 is formed of a non-conductive material, more specifically, a non-magnetic material such as alumina, a magnetic material such as a ferrite, or a resin, for example. The plate-shaped core 56 is fixed to the drum-shaped core 32 using an adhesive.

Next, the structures of the terminal electrodes 50 to 53 will be described in detail while also referring to FIGS. 3 and 4 in addition to FIGS. 1 and 2. Since the shapes and sectional structures of the terminal electrodes 50 to 53 are substantially identical, hereafter, the first terminal electrode 50 illustrated in FIGS. 3 and 4 will be described in detail and detailed description of the other terminal electrodes 51 to 53 will be omitted.

Figure 3:
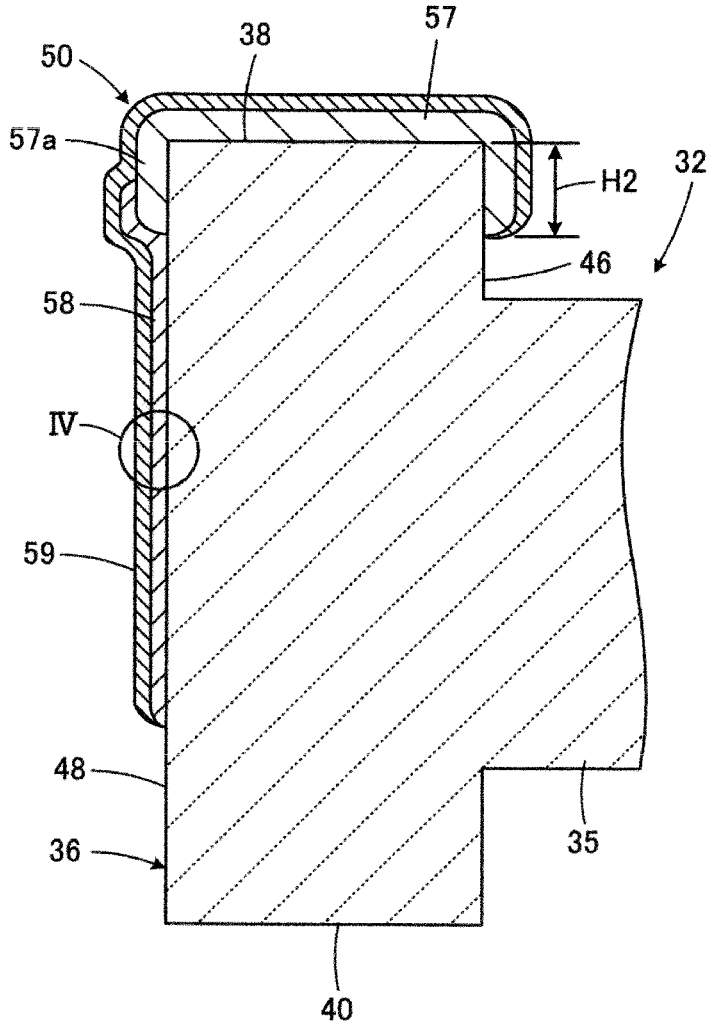
FIG. 3 is a sectional view taken along line in FIG. 2 illustrating a first flange part of the drum-shaped core illustrated in FIG. 2 in an enlarged manner.

As illustrated in FIG. 3, the first terminal electrode 50 has a bottom surface electrode portion 57, which is positioned along the bottom surface 38 of the first flange part 36, an end surface electrode portion 58, which is positioned along the outer end surface 48 of the first flange part 36, and a plating film 59 that covers the bottom surface electrode portion 57 and the end surface electrode portion 58 in a continuous manner. The bottom surface electrode portion 57 contains Ag and Si, and the end surface electrode portion 58 is composed of a metal film that does not contain Si as a glass component. Thus, when the end surface electrode portion 58 is composed of a metal film that does not contain Si, a non-conductive component of the end surface electrode portion 58 is reduced, and therefore the end surface electrode portion 58 can be formed so as to be thin and the outer dimensions of the coil component 31 can be reduced.

The bottom surface electrode portion 57, which contains Ag and Si, is a baked thick film formed by preparing a conductive paste that includes Ag powder as a conductive component and Si as a glass component, coating the bottom surface 38 of the flange part 36 with the conductive paste using a dipping technique, and then performing baking. The thickness of the bottom surface electrode portion 57 is around 20 μm. The bottom surface electrode portion 57 is formed not only on the bottom surface 38, but also so as to extend from the bottom surface 38 onto part of each of the outer end surface 48, the inner end surface 46, the first side surface 42, and a side surface 54*a* that is parallel to the first side surface 42 and defines the recess 54, these surfaces being adjacent to the bottom surface 38. The height of these adjacent surface extension portions is indicated by "H2" in FIG. 3.

On the other hand, the metal film forming the end surface electrode portion 58 is composed of a sputtered thin film containing Ni, Cr, and Cu, for example. The end surface electrode portion 58 is formed so as to have a specific pattern in a specific region of the outer end surface 48, and therefore a mask is used in the sputtering process. Since it takes a relatively long time to form the end surface electrode portion 58 using sputtering, the work time taken to perform the sputtering process can be reduced to a shorter time by making the thickness of the end surface electrode portion 58 smaller so as to be less than or equal to 2.0 μm, for example, 1.6 μm. In addition, by making the thickness of the end surface electrode portion 58 small relative to the bottom surface electrode portion 57, which has a relatively large thickness, the effect of the end surface electrode portion 58 on the outer dimensions of the coil component can be reduced.

As illustrated in FIG. 3, the end surface electrode portion 58 overlaps part of an outer end surface extension portion 57*a* of the bottom surface electrode portion 57 that extends onto part of the outer end surface 48. Thus, a secure electrical conductive state can be realized between the bottom surface electrode portion 57 and the end surface electrode portion 58 by providing this part where the outer end surface extension portion 57*a* of the bottom surface electrode portion 57 and the end surface electrode portion 58 overlap.

Regarding this part where the outer end surface extension portion 57*a* of the bottom surface electrode portion 57 and the end surface electrode portion 58 overlap as described above, in this embodiment, the end surface electrode portion 58 overlaps the outer end surface extension portion 57*a* so as to cover part of the outer end surface extension portion 57*a*. The overlapping order arises from the manufacturing method. In other words, this is because the bottom surface electrode portion 57 is formed first, and then the end surface electrode portion 58 is formed. As described above, the bottom surface electrode portion 57 is formed of a baked thick film, and therefore a step of baking the bottom surface electrode portion 57 accompanies the step of forming the bottom surface electrode portion 57. Therefore, oxidation, degradation, and so forth of the end surface electrode portion 58 caused by the sputtered thin film forming the end surface electrode portion 58 being exposed to a high temperature in the baking step for forming the bottom surface electrode portion 57 can be prevented by forming the end surface electrode portion 58 after the bottom surface electrode portion 57 and making the end surface electrode portion 58 overlap and cover part of the outer end surface extension portion of the bottom surface electrode portion 57.

Figure 4:
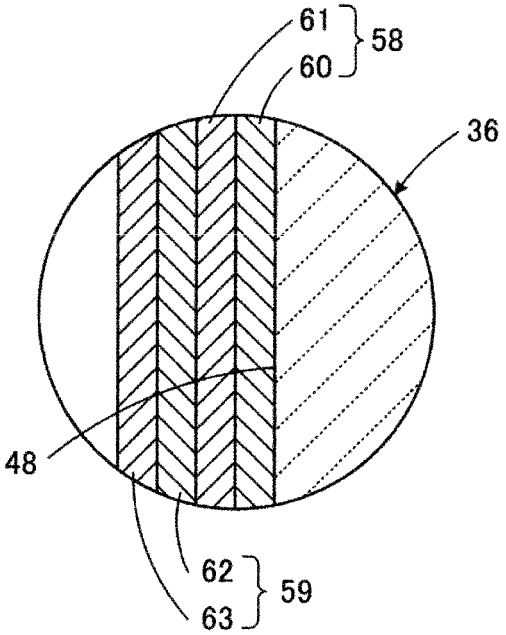
FIG. 4 is a sectional view illustrating a part enclosed by a circle IV in FIG. 3 in a further enlarged manner.
Figure 5:
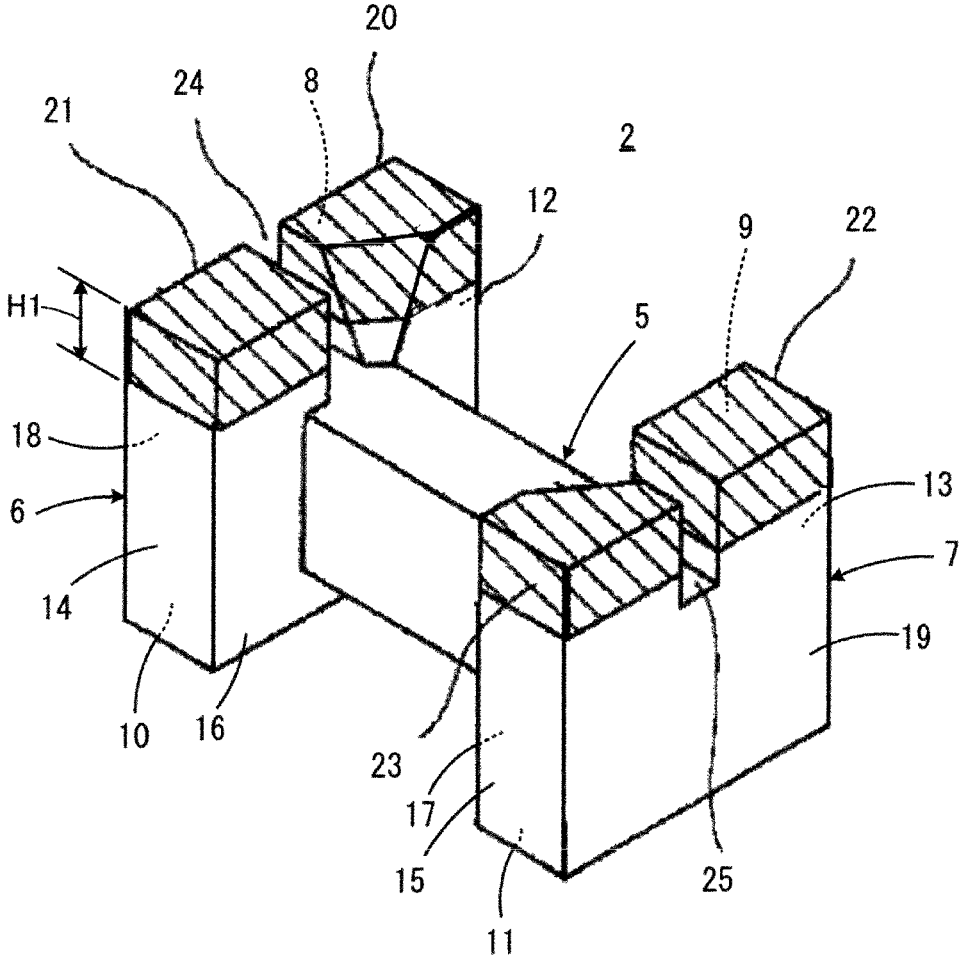
FIG. 5 is a perspective view illustrating a drum-shaped core of a coil component disclosed in Japanese Unexamined Patent Application Publication No. 11-204346.

As illustrated in FIG. 4, the metal thin film forming the end surface electrode portion 58 preferably includes a first metal layer 60 containing Ni and Cr and a second metal layer 61 formed on the first metal layer 60 and containing Ni and Cu.

The Cr contained in the metal film forming the end surface electrode portion 58, specifically, the Cr contained in the first metal layer 60 contributes to improving the adhesive force with which the end surface electrode portion 58 is adhered to the drum-shaped core 32. From the viewpoint of improving the adhesive force, the content percentage of Cr in the first metal layer 60 is preferably 5-20 vol %. Adhesion of the first metal layer 60 to the drum-shaped core 32 can be secured with certainty when the content percentage of Cr in the first metal layer 60 is greater than or equal to 5 vol %. In addition, adhesion of the first metal layer 60 to the second metal layer 61 can be secured with certainty when the content percentage of Cr in the first metal layer 60 is less than or equal to 20 vol %.

The outermost surface of the first terminal electrode 50 is formed by the plating film 59. As described above, the plating film 59 covers the bottom surface electrode portion 57 and the end surface electrode portion 58 in a continuous manner. As illustrated in FIG. 4, for example, the plating film 59 includes a Ni plating layer 62 and a Sn plating layer 63 formed on the Ni plating layer 62.

In this embodiment, as described above, there is a part where the outer end surface extension portion 57*a* of the bottom surface electrode portion 57 and the end surface electrode portion 58 overlap, but since the plating film 59 covers the bottom surface electrode portion 57 and the end surface electrode portion 58 in a continuous manner, such an overlapping part is not essential. For example, an edge of the bottom surface electrode portion 57 and an edge of the end surface electrode portion 58 may abut against each other or the edge of the bottom surface electrode portion 57 and the edge of end surface electrode portion 58 may be slightly separated from each other.

The terminal electrodes 51 to 53, which are not illustrated in FIGS. 3 and 4, have the same shape and sectional structure as the first terminal electrode 50 described above.

According to the above-described embodiment, as can be inferred from FIGS. 1 and 2, the end surface electrode portions of the two first terminal electrodes 50 and 51 are arranged so as to be arrayed in a direction parallel to the bottom surface 38 along the outer end surface 48 of the first flange part 36. Furthermore, the end surface electrode portions of the two second terminal electrodes 52 and 53 are arranged so as to be arrayed in a direction parallel to the bottom surface 39 along the outer end surface 49 of the second flange part 37.

Thus, forming the end surface electrode portions of the terminal electrodes 50 to 53 so as to have specific patterns in specific regions on the outer end surfaces 48 and 49 can be easily realized by forming the end surface electrode portions using a sputtering technique rather than a dipping technique.

Description of an illustrated embodiment has been given above, but various other embodiments are possible.

For example, the above-described embodiment relates to a coil component included in a common mode choke coil, but it is sufficient that an embodiment of the present disclosure be a coil component including two or more wires and an embodiment of the present disclosure may be another coil component included in a transformer, a balun, or the like. Furthermore, the number of wires will be changed in accordance with the function of the coil component, and a case in which the number of terminal electrodes provided on each flange part is three or more in accordance with the number of wires is also possible.

In addition, a number of modifications described in connection to the illustrated embodiment can be appropriately combined with each other to form further embodiments.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a substantially drum-shaped core having a winding core part, and a first flange part and a second flange part, which are respectively provided at a first end and a second end, which are opposite ends, of the winding core part;

a first wire and a second wire that are wound around the winding core part; and terminal electrodes that are each provided on the first flange part or the second flange part, a first end or a second end, which are opposite ends, of the first wire is electrically connected to a first one of the terminal electrodes, and a first end or a second end, which are opposite ends, of the second wire is electrically connected to a second one of the terminal electrodes;

wherein the first flange part and the second flange part each have a bottom surface that faces a mounting substrate at a time of mounting, a top surface that faces in an opposite direction from the bottom surface, an inner end surface that faces the winding core part, and an outer end surface that faces outwardly on an opposite side from the inner end surface, the inner and outer end surfaces extending in a direction perpendicular to the mounting substrate, the terminal electrodes each include a bottom surface electrode portion having a part that is positioned along the bottom surface, an end surface electrode portion that is positioned along the outer end surface, and a plating film that covers the bottom surface electrode portion and the end surface electrode portion in a continuous manner, the bottom surface electrode portion contains Ag and Si and the end surface electrode portion is composed of a metal film, and the end surface electrode portion does not extend onto an area of the outer end surface that meets the bottom surface and does not extend onto an area of the outer end surface that meets the top surface.

2. The coil component according to claim 1, wherein the bottom surface electrode portion includes an outer end surface extension portion that extends from the bottom surface onto part of the outer end surface, and the end surface electrode portion overlaps part of the outer end surface extension portion.

3. The coil component according to claim 2, wherein the end surface electrode portion overlaps and covers part of the outer end surface extension portion.

4. The coil component according to claim 1, wherein the metal film does not contain Si.

5. The coil component according to claim 1, wherein the metal film contains Ni, Cr, and Cu.

6. The coil component according to claim 5, wherein the metal film includes a first metal layer that contains Ni and Cr and a second metal layer that is formed on the first metal layer and contains Ni and Cu.

7. The coil component according to claim 6, wherein a Cr content percentage of the first metal layer is 5 to 20 vol %.

8. The coil component according to claim 1, wherein a thickness of the end surface electrode portion is less than or equal to 2.0 μm.

9. The coil component according to claim 1, wherein a plurality of the terminal electrodes are provided on each of the first flange part and the second flange part, and the end surface electrode portions of the plurality of terminal electrodes provided on the first flange part are arrayed in a direction parallel to the bottom surface on the outer end surface of the first flange part, and the end surface electrode portions of the plurality of terminal electrodes provided on the second flange part are arrayed in a direction parallel to the bottom surface on the outer end surface of the second flange part.

10. The coil component according to claim 1, wherein the bottom surface electrode portion is a baked thick film containing Ag and Si, and the end surface electrode portion is a sputtered thin film composed of a metal film, and the baked thick film has a thickness at least ten times greater than a thickness of the sputtered thin film.

11. The coil component according to claim 10, wherein the end surface electrode portion does not extend onto the part of the bottom surface electrode portion that is positioned along the bottom surface.

12. A coil component comprising:

a substantially drum-shaped core having a winding core part, and a first flange part and a second flange part, which are respectively provided at a first end and a second end, which are opposite ends, of the winding core part;

a first wire and a second wire that are wound around the winding core part; and terminal electrodes that are each provided on the first flange part or the second flange part, a first end or a second end, which are opposite ends, of the first wire is electrically connected to a first one of the terminal electrodes, and a first end or a second end, which are opposite ends, of the second wire is electrically connected to a second one of the terminal electrodes;

wherein the first flange part and the second flange part each have a bottom surface that faces a mounting substrate at a time of mounting, a top surface that faces in an opposite direction from the bottom surface, an inner end surface that faces the winding core part, and an outer end surface that faces outwardly on an opposite side from the inner end surface, the inner and outer end surfaces extending in a direction perpendicular to the mounting substrate, the terminal electrodes each include a bottom surface electrode portion having a part that is positioned along the bottom surface, an end surface electrode portion that is positioned along the outer end surface, and a plating film that covers the bottom surface electrode portion and the end surface electrode portion in a continuous manner, the bottom surface electrode portion contains Ag and Si and the end surface electrode portion is composed of a metal film, and the metal film includes a first metal layer that contains Ni and Cr and a second metal layer that is formed on the first metal layer and contains Ni and Cu.

13. The coil component according to claim 12, wherein a Cr content percentage of the first metal layer is 5 to 20 vol %.

* * * * *